US006845792B2

(12) United States Patent
Scari et al.

(10) Patent No.: US 6,845,792 B2
(45) Date of Patent: Jan. 25, 2005

(54) THREAD CLAMP FOR A CARRIER THREAD GRIPPER IN A RAPIER LOOM

(75) Inventors: Diego Armando Scari, Brugherio (IT); Marco Scari, Brugherio (IT)

(73) Assignee: Gividi-Italia SpA, Brugherio (IT)

( * ) Notice: Subject to any disclaimer, the term of this patent is extended or adjusted under 35 U.S.C. 154(b) by 352 days.

(21) Appl. No.: 10/109,656

(22) Filed: Apr. 1, 2002

(65) Prior Publication Data

US 2003/0183297 A1 Oct. 2, 2003

(51) Int. Cl.[7] ..... D03D 47/20

(52) U.S. Cl. ..... 139/448; 139/116.1; 139/437; 139/438; 139/439; 139/444; 139/445; 139/446

(58) Field of Search ..... 139/116.1, 437, 139/438–439, 443–448, 450, 216; 26/93, 94; 28/208; 66/146, 134, 140 R, 145 R

(56) References Cited

U.S. PATENT DOCUMENTS 2,350,961 A * 6/1944 Haskins ..... 26/94
3,532,136 A * 10/1970 Golobart ..... 139/448
3,602,266 A * 8/1971 Duplessy ..... 139/446
4,450,874 A * 5/1984 Brouwer et al. ..... 139/429
4,520,851 A * 6/1985 Rohr et al. ..... 139/448
5,074,340 A * 12/1991 Oderbolz et al. ..... 139/453
5,386,853 A * 2/1995 Speich ..... 139/1 C
6,006,795 A * 12/1999 Corain et al. ..... 139/453
6,026,864 A * 2/2000 Corain et al. ..... 139/449
6,058,980 A * 5/2000 Scari et al. ..... 139/302
6,119,733 A * 9/2000 Arndt et al. ..... 139/453
6,305,434 B1 * 10/2001 Speich ..... 139/448

* cited by examiner

*Primary Examiner*—John J. Calvert
*Assistant Examiner*—Robert H Muromoto, Jr.
(74) *Attorney, Agent, or Firm*—Greenblum & Bernstein, P.L.C.

(57) ABSTRACT

Thread clamping arrangement for a carrier gripper of a rapier loom wherein the arrangement includes a rigid support coupled to a lateral wall of a body of the carrier gripper. Each of an elongated first clamping element and an elongated second clamping element are provided. A clamping gap is formed by the first and second clamping elements. A magnet is included that exerts an attracting force on each of the first and second clamping elements.

47 Claims, 2 Drawing Sheets

B
A
A
n
m
L
W
1
2
3
4
5
6
7
8
9
10
13
14
15
16
f'
f''

THREAD CLAMP FOR A CARRIER THREAD GRIPPER IN A RAPIER LOOM

BACKGROUND OF THE INVENTION

1. Field of the Invention

The present invention concerns a thread clamp for a carrier thread gripper in a (flexible) rapier loom.

2. Discussion of Background Information

A carrier gripper must clamp a weft thread with utmost reliability, without which the thread could shift in the gripper or even escape therefrom, but it must handle the thread very gently without impairing its structure. This requirement is of particular importance in processing filament yarns, especially multifilament glass fiber, and especially if filament threads without twist are to be handled. This type of thread is used for very specific applications, e.g. in the manufacture of electronic components, and one of the main requirements a thread of this type must meet is the absolute absence of broken filaments, as any broken fibril may cause severe defects in the finished product. Clamping a thread of this type in the thread carrier gripper thus must be effected in a reliable manner, but without breaking any fibrils in the clamping device. Furthermore the clamping conditions prevailing in the clamping mechanism are to remain constant over time and thus are to be influenced as little as possible by wear of the elements, which is quite considerable, caused by the preparation to which such threads are subject, affecting the elements contacted by the thread.

Several options to solve the problem mentioned are known. However, these options have not proven satisfactory.

Thus, from EP-0477139, a carrier gripper for rapier looms is known comprising a cover plate and two lateral walls, which on the outer side of the lateral wall facing the warp shed forms a clamp for gripping the weft thread. The clamp is formed by a small clamping bar mounted on a support member fixed onto one of the lateral walls of the gripper. The clamping zone comprises, in a preferred variant of realization, a pliable clamping tape covered by a cushion of elastic material. Clamping of the thread is effected between the clamping bar and the elastic cushion. This clamping device, which has proven superior to the conventional clamping arrangements using levers and springs—as known from the state of the art and commonly used for clamping un-problematic threads of natural fibers, etc.—has been found insufficient, however, for meeting the extreme requirements described above. In the clamping arrangement cited, wear problems arise with the elastic cushion, in such a manner that the clamping force progressively diminishes over time until it no longer ensures reliable clamping of the thread.

The solution shown in EP-0584429 B1, according to which the thread is clamped and is inserted between two surfaces enclosing the wedge shaped gap, which surfaces furthermore present a curved cross-section shape, does not yield the desired results. On the one hand, it is subject to the effects of progressive wear, which tends to cause variations in the clamping force exerted onto the thread, and on the other hand, it has been found in practical use that adapting the clamping device to the thickness and the type of thread being processed is most difficult and requires a degree of precision in alignment which in weaving operations often is not available. Also this clamping device, developed just for meeting the demand specified for the present invention, did not yield the desired results.

SUMMARY OF THE INVENTION

The present invention eliminates the disadvantages of the known solutions, and in particular, proposes a clamping arrangement in which it is possible to:

eliminate the effect of wear affecting the clamping force, in particular to ensure that the clamping force be independent of the inevitable wear of the elements contacting the thread;

obtain a reliable thread clamping action, which, however, excludes any danger of tearing individual fibrils. For this purpose it is indispensable that the thread be "closed in" from both sides in a kind of an "enclosed chamber", which prevents any single fibrils from not being clamped; and easily adapt the clamping force to the thickness and to the characteristics of the thread being processed.

These and other objectives are met using a clamping arrangement for a carrier gripper presenting the characteristics described herein. Owing to the fact that the two elements of the clamping arrangement are pressed against each other under the influence of the attracting force exerted onto each of them by a magnet in such a manner that the width of the clamping gap no longer has any influence onto the clamping forces, as was the case in the solution shown in the EP-0584429 B1, the magnet always attracting the two elements mutually in practical application with the same force, even if their clamping surfaces might be subject to a certain wear over time.

The invention provides for a thread clamping arrangement for a carrier gripper of a rapier loom comprising a rigid support coupled to a lateral wall of a body of the carrier gripper, an elongated first clamping element, an elongated second clamping element, a clamping gap being formed by the first and second clamping elements, and a magnet that exerts an attracting force on each of the first and second clamping elements.

The first and second clamping elements may be pressed against each other by the attracting force of the magnet. The clamping gap may be adapted to receive at least one of a weft thread, a filament thread, and multifilament and/or glass thread. The weft thread may be adapted to be retained in the clamping gap after the weft thread is inserted therein. Each of the first and second clamping elements may be arranged between the rigid support member and the lateral wall of the body.

The magnet may comprise a permanent magnet. The magnet may comprise a magnetized elongated bar of square cross-section. The magnet may be arranged to apply the attracting force to an elongated zone that is arranged between the first and second clamping elements.

Each of the first and second clamping elements may comprise a thin elongated plate. Each of the first and second clamping elements may comprise one end that is freely movable and another end that is fixed. The fixed end of each of the first and second clamping elements may be trapped between the rigid support member and the wall of the body. The magnet may be arranged to apply the attracting force to an elongated zone that is arranged on the freely movable ends of the first and second clamping elements. The magnet may be at least one of coupled to the rigid support and incorporated into the rigid support. The magnet may be arranged in a recess that is formed in the rigid support. The first clamping element may be arranged adjacent the rigid support and the second clamping element may be arranged adjacent the lateral wall of the body.

The first clamping element may comprise a thickness that is greater than a thickness of the second clamping element. The second clamping element may be adapted to deform locally in order to trap a weft thread. The second clamping element may be adapted to deform locally via the magnet in order to trap a weft thread. The second clamping element may be adapted to deform locally in order to trap a weft thread. At least one of the first and second clamping elements may be removably mounted. The magnet may be removably mounted. The second clamping element may be adapted to deform locally in order to trap a weft thread in such a manner that the weft thread is prevented from moving in at least two directions.

The thread clamping arrangement may further comprise at least one of a spacer and a plate arranged between the first and second clamping elements. Each of the first and second clamping elements may comprise one end that is freely movable and another end that is fixed. The fixed end of each of the first and second clamping elements, and the spacer or plate, may be trapped between the rigid support member and the wall of the body. The thread clamping arrangement may further comprise a third clamping element coupled to the rigid support.

At least one of the first, second and third clamping elements may be fastened to the body of the carrier gripper.

The third clamping element may be pressed against a rigid support by the attracting force of the magnet. The third clamping element may be attached to a surface of the rigid support that is oriented at approximately a right angle relative to one of the clamping gap and the lateral wall of the body. The thread clamping arrangement may further comprise another clamping gap formed by the third clamping element and the surface of the rigid support. The third clamping element may be removably mounted. The third clamping element may comprise a thickness that is adapted to a characteristic of a weft thread. The characteristic may comprise a linear density of the weft thread. The characteristic may comprise a linear density measured in "tex" of the weft thread. The thickness of the third clamping element may be in the range of between approximately 0.1 mm to approximately 0.3 mm. A thickness of the second clamping element may be in the range of between approximately 0.1 mm to approximately 0.5 mm. The thickness of the second clamping element may be in the range of between approximately 0.2 mm to approximately 0.3 mm.

Each of the first and second clamping elements may comprise one of curved and rounded edges. Each of the first and second clamping elements may comprise one of curved and rounded lateral side edges. Each of the first and second clamping elements may comprise one of curved and rounded free ends. Each of the first and second clamping elements may comprise a clamping surface which is at least one of smooth and highly polished. The thread clamping arrangement may further comprise a third clamping element having a thickness ranging from approximately 0.1 to approximately 0.3 mm. The magnet may exert an attracting force which is in the range of between approximately 20 g and approximately 200 g measured as a tensile force required for pulling a thread out of the clamping arrangement. The clamping gap may be adapted to retain filament threads of a linear density ranging from approximately 5.5 tex to approximately 140 tex.

The thread clamping arrangement may further comprise at least one of a spacer and a plate arranged between the first and second clamping elements and wherein at least one of the second clamping element and the spacer and plate is exchangeable.

The invention also provides for a thread clamping arrangement for a carrier gripper of a rapier loom comprising a support coupled to a body of the carrier gripper, a thin elongated first clamping element, a thin elongated second clamping element, a clamping gap being formed by the first and second clamping elements, and a magnet, wherein the magnet causes the second clamping element to move towards the first clamping element.

The invention further provides for a thread clamping arrangement for a carrier gripper of a rapier loom comprising a support coupled to a body of the carrier gripper, a thin elongated first clamping element, a thin elongated second clamping element, a thin elongated third clamping element, a main clamping gap being formed by the first and second clamping elements, an additional clamping gap being formed by the third clamping element and the support, and a magnet, wherein the magnet exerts an attractive force on each of the first, the second and the third clamping elements.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figures 1, 2, 3:
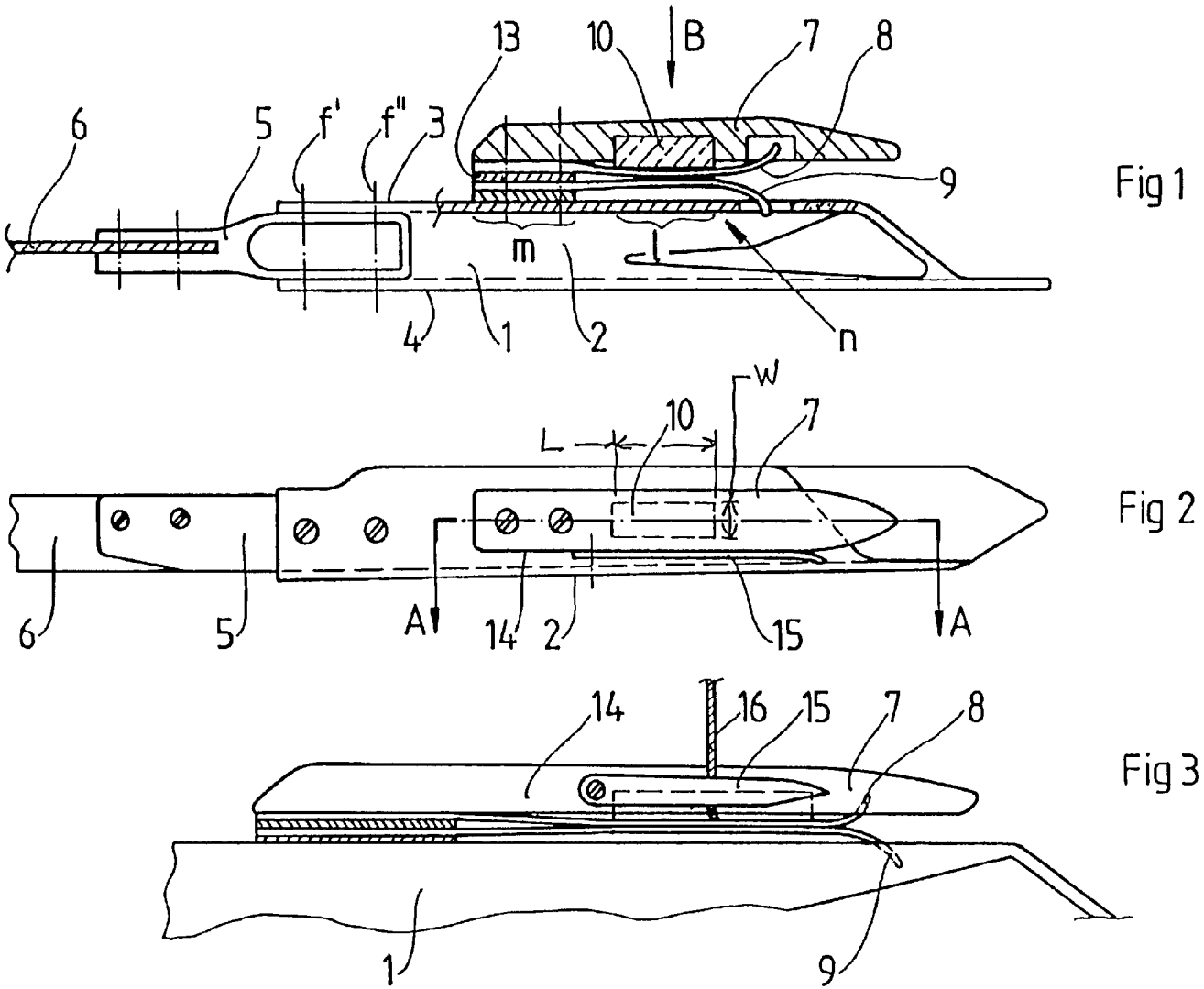
FIG. 1 shows a top view of the carrier gripper with the inventive thread clamping arrangement in a section along the plane A—A according to FIG. 2. These are shown schematically, and the elements are shown in actual and/or relative scale in order to facilitate interpretation of the invention.
FIG. 2 shows a lateral view of the gripper according to the FIG. 1 as seen in the direction of the arrow B according to the FIG. 1.
FIG. 3 shows an enlarged view of the inventive clamp in a view corresponding to the one in FIG. 1, namely in a top view, but in section, the elements being represented according to a scale reciprocal compared to actuality.

FIG. 1 shows a body 1 of the carrier gripper which is normally made from thin sheet metal. The body 1 is formed as having an essentially U-shaped profile with an upper face 2 and two lateral walls 3 and 4.

In its back portion, i.e. to the left side of FIG. 1, the body 1 of the gripper is connected and/or attached to a fixation element 5 that is made from a light metal. An activating rapier tape 6 is fastened and/or attached to the fixation element 5. The arrangement of the activating tape 6, the fixation element 5, and the body 1 of the gripper represent one of two rapiers of the loom. In particular, the illustrated gripper is part of a carrier rapier, which transports the thread to the middle portion of the fabric. From there, it is taken over and gripped by a pulling gripper and is transported to the other selvedge of the fabric.

The present invention is mainly concerned with just the clamp that is provided on the carrier gripper, i.e., the clamp which is used for clamping the thread at the selvedge of the fabric and transporting it into the warp shed to the center zone of the fabric. The inventive clamping arrangement is fastened and/or otherwise attached to the lateral wall 3 of the gripper using screws (of which only the axes f' and f" are shown in FIG. 1). However, other connection mechanisms may be utilized, whether conventional or otherwise. The clamping arrangement essentially includes a rigid support member 7 and two clamping elements 8 and 9 which are of elongated form and which are pressed against each other and/or otherwise engage each other.

It should be noted first of all, that the lateral wall 3 of body 1 of the gripper is the one which extends towards the lower side of the warp (not shown). According to this definition, the position of the gripper with respect to the fabric being produced remains perfectly defined.

The rigid support member 7 includes a recess that houses and/or is otherwise adapted to receive a magnet 10. The magnet 10 is arranged and/or otherwise retained in the recess and is preferably a permanent magnet. The magnet 10 has a surface that engages a s surface of a first clamping element 8. The surface of magnet 10 can be arranged in the same plane as a surface of the rigid support 7 or it can preferably slightly protrude beyond this plane (as shown in FIG. 1), in order to ensure direct metallic contact between the surface of the magnet 10 and the clamping element 8.

The first clamping element 8 as well as the second element 9 are ferromagnetic, and are thus preferably formed as a thin steel plates, so that they can be easily attracted to each other and in such a manner that they form a main clamping or gripping gap. Of course, these small plates 8 and 9 are both attracted towards the magnet 10.

The thickness of the small plates of the clamping elements 8 and 9 play an important role within the scope of the present invention and permit variations of the functioning of the clamping arrangement, which will be explained in more detail herein.

In any case, it should be noted that the thickness of the elements or plates 8 and 9 is on the order of tenths of a millimeter, and can be as great as approximately 0.5 mm. In order to facilitating interpretation, the Figures are not represented according to real scale so that these plates 8 and 9 can be better illustrated. Accordingly, the thickness of the elements 8 and 9 are shown in all of the Figures, much exaggerated with respect to their real and/or relative values.

The permanent magnet 10 is preferably formed as a small elongated bar having a square cross-section. Moreover, it is preferred that the magnet 10 be incorporated into the rigid support member 7 in a location that allows it to apply an attracting force to an elongated zone "l" (see FIG. 1) of the two clamping elements 8 and 9. The clamping plates 8 and 9 are both formed as elongated plates having a free end "n" part that is curved and another end "m" that is solidly fastened or connected to the gripper. In the fastening zone "m", one end of each clamping element 8 and 9 is clamped between rigid support 7 and wall 3 of body 1 via, e.g., fasteners (see FIG. 2). The portion of the clamping elements 8 and 9 which are not fixed are free to move against each other at their other extremities "n", i.e., in the space between the rigid support 7 and the wall 3 of the body of the gripper 1. The attraction force of the magnet 10 acting onto the clamping elements 8 and 9, thus acts on the free extremity portions "n" of the clamping elements 8 and 9. Of course, this attraction is strongest in the zone "l".

It is evident, that one way of regulating the attraction force of the clamping arrangement is to vary and/or change the magnet 10 itself, i.e., its size and/or its strength, so that it exerts more or less magnetic force. In this respect, it should be noted that, in the sense of a mere example, that experience has shown, that for obtaining reliable clamping of a thread 11, the clamping force exerted between the two elements 8 and 9 of the clamping arrangement, when measured as tensile force required to pull the thread out of the clamp, should range between approximately 20 g (grams) and approximately 200 g (grams) for threads of a linear density ranging from approximately 5.5 tex to approximately 140 tex. A clamping or gripping force of this order can be realized without problems using a permanent magnet 10, whose dimensions include a length of approximately 15 mm and whose cross-section is of approximately 5×4 mm, i.e., W=5 mm and H=4 mm. These dimensions can be easily integrated and/or provided in the known lay-out of a carrier gripper without causing particular problems concerning dynamic behavior.

Figure 4:
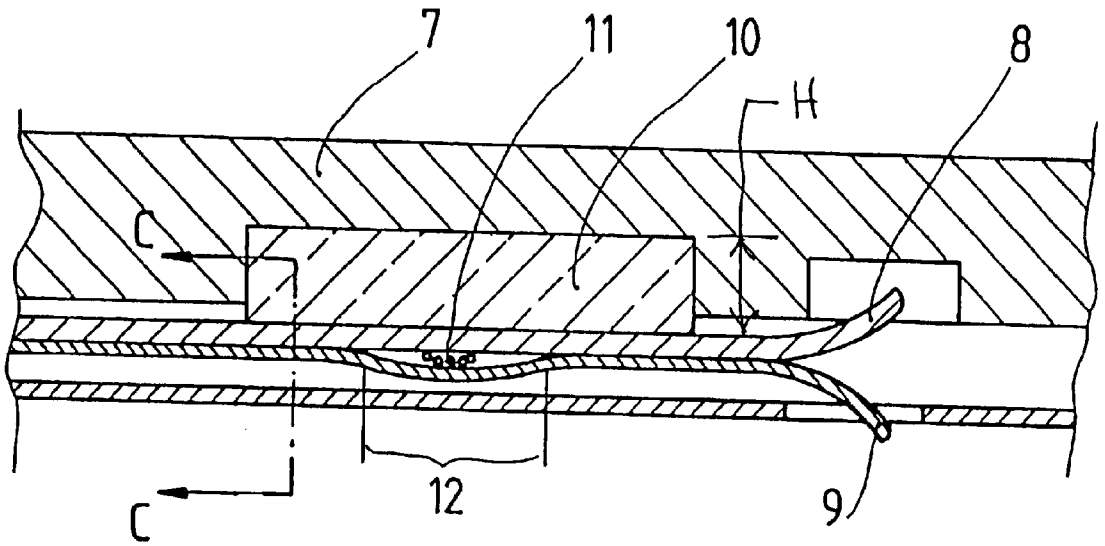
FIG. 4 shows an enlarged detail of the clamping zone of the inventive clamping arrangement, showing a preferred type of thread clamping in more detail.

Another possibility which provides an even more practical application of the invention, relates to using only one type of permanent magnet 10. According to this aspect of the invention, the clamping force is adapted to the type of thread by varying the thickness of one of more of the plates 8 and 9. In this regard, FIG. 4 illustrates a small plate 8 of the clamping arrangement arranged on the side of the rigid support 7 that is chosen to be of a thickness that is greater than the small plate 9 arranged on the side of the lateral wall 3 of the body 1 of the gripper. The thickness of the small plate 9 is preferably chosen in such a manner that (as shown in FIG. 4), as the weft thread 11 is inserted between the two small plates 8 and 9, the plate 9 can be deformed locally, under the influence of the attracting force exerted by the magnet 10, so as to leave room for the thread 11. As can be seen in FIG. 4, this local deformation forms a kind of a niche 12 which encloses the thread 11 in a kind of a chamber that is closed off from both sides. This possibility of enclosing the thread 11 with all its fibrils is most important because it permits protection of all fibrils of the thread 11 against the danger of being ripped or torn off and ruptured at the moment of transfer of the thread 11 from the carrier gripper to the pulling gripper. Experience has shown that correct transfer of the head end of the thread can be achieved only if all the fibrils of the thread are perfectly controlled in their position, i.e. if they are positively gripped between the two cooperating surfaces of the clamping elements 8 and 9.

A further characteristic of the present invention relates to the small plate 9, i.e. the one arranged on the side of the lateral wall 3 of the body 1 of the gripper 1, being adapted to be exchangeable and/or otherwise removable or replaceable. This means that the thickness of the plate 9 can be perfectly adapted to the desired characteristics, and in particular, can be adapted to a linear density expressed in tex of the thread 11. Obviously, the width of the niche 12 formed as an enclosed chamber between the two clamping elements 8 and 9 depends on the number of fibrils, and thus on the linear density of the weft thread being processed. Thus, when a fine thread 11 is to be transferred (e.g. 5.5 tex), a thinner plate 9 will be chosen and/or utilized, since a thinner plate 9 will better hug the outline of the thread 11, i.e., enclosing it in a smaller chamber. When a thicker thread is to be transferred (e.g. 140 tex), a thicker plate 9 is preferred, because a greater force must be applied to the thread 11 in order to ensure its reliable clamping. This is made possible by increasing the mass of the plate 9 attracted by the magnet 10. Experience has proven that an interchangeable plate 9 functions well in a thickness ranging from approximately 0.1 mm to approximately 0.5 mm, and preferably ranging from approximately 0.1 mm to approximately 0.3 mm. The use of these thicknesses offers ideal clamping conditions that can be established for all filament threads ranging from approximately 5 tex to approximately 200 tex. Such filament threads come under consideration for all and/or most industrial applications, to which the present invention is aimed.

According to a further preferred variant of the present invention, there is arranged, between the two small plates 8 and 9, a spacing or distancing plate 13. This plate 13 is arranged in the fixing zone "m". This distancing plate 13 fulfils two purposes. On the one hand, it permits better mutual adaptation of the two small plates 8 and 9, i.e., if they are provided with a spaced zone between them, they can perform small torsional movements, which possibly are required for allowing them to contact each other in the zone "l" without restrictions. This arrangement also ensures that clamping conditions in the zone "l" are independent of possible small deviations of the plates from their ideal plane, which helps to overcome a problem, which was very difficult to solve in the preceding attempts of solving the main problem, such as one that is encountered in EP 0584429 B1.

Furthermore, the interspace thus formed between the small plates 8 and 9 in the zone immediately preceding the zone of fixation "m" (i.e., the zone between zones "m" and "l") permits easy removal of any impurities or debris, that has possibly accumulated during operation, between the two small plates 8 and 9. As a result, one can simply insert a thin strip of paper between the two small plates 8 and 9 from the direction of their free ends to remove any fiber or preparation particles that have accumulated in the free interspace between the two small plates 8 and 9.

In a further preferred form of the present invention, there is provided (see FIGS. 2 and 3), on the upper surface 14 of the rigid support member 7 (wherein the upper surface is meant to designate the surface facing upward in the working position of the gripper) a third small thread clamping plate 15. This plate 15 has one end that is fixed to the rigid support via a fastener (see FIG. 3) and is designed to also be attracted (downward of course) by the attraction force of the magnet 10 against the upper surface 14 of the rigid support member 7. The small plate 15 thus forms a thread clamping gap which extends at a right angle with respect to the main clamping gap (i.e., between plates 8 and 9) of the thread clamping arrangement. The purpose of this clamping gap that is formed by the small plate 15 and the surface 14, is to hold the tail 16 of a cut thread in such a manner that it sticks out of the gripper in practically the horizontal direction (see FIG. 3). Experience has shown that if the tail end 16 of the thread cut and clamped between the clamping plates 8 and 9 is not deviated, bent and/or otherwise deflected (by or over 90°), it sticks out of the gripper vertically upward and causes many problems of contamination as it bangs against the warp threads. Deviation of the thread tail 16 by or over 90° in a horizontal plane prevents contact of the thread tail 16 on the warp threads in the shed and effectively eliminates all problems of contamination of, and of damage to, the warp threads.

Figure 5:
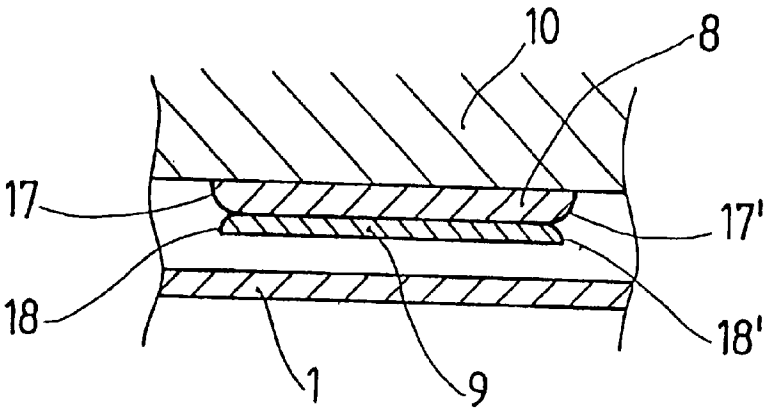
FIG. 5 shows a cross-section shown slightly enlarged in comparison to FIG. 4 along the line C—C showing a construction detail of the small plates forming the clamping arrangement.

FIG. 5 represents a section along the line C—C of a detail according to FIG. 4, and illustrates a further preferred variant of the present invention. According to this variant, the small plates 8 and 9 are each provided with rounded edges 17, 17', and 18, 18' respectively, on their portions that enclose the thread clamping gap. Furthermore, their surfaces forming the clamping gap can be highly polished and smoothed. These measures serve the purpose of ensuring gentle clamping of the weft thread 11, and above all, of permitting release of the thread 11 from the clamping gap at the moment of the thread transfer from the carrier gripper to the pulled gripper, without any danger of single fibrils left clinging to one of the surfaces of the plates 8 and 9 or to their edges in particular, and consequently being torn.

The invention also contemplates that the third small plate 15 is of a thickness ranging from approximately 0.1 mm to approximately 0.3 mm. These dimensions ensure best operating conditions for the auxiliary clamp formed by the small plate 15 and the rigid support 7.

The arrangements described above are considered as mere samples of realization of a magnetic clamping arrangement applied to a carrier gripper of a rapier loom. It is evident that many other variants also are possible of the clamping arrangement described here, be it concerning the conformation and the arrangement of the magnet, which can be e.g. of another type than a permanent magnet, also e.g. one activated by an exciter, or which can present other geometric shapes differing from the bar shape shown. Also the thickness and the shape of the small plates, and in particular the choice of their contours, can undergo variations deviating from the forms shown here, without, however, exceeding the frame of the present invention, the main advantage of which is the effective and complete elimination of fibril rupture at the moment of transfer of the thread from the carrier gripper to the pulling gripper.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF THE ELEMENTS REFERRED TO IN THE FIGURES

1 body of the gripper
2 upper surface
3 lateral wall
4 lateral wall
5 fastening element
6 activating rapier tape
7 rigid support
8 clamping element of elongated form
9 clamping element of elongated form
10 magnet
11 weft thread
12 niche, recess
13 small distancing plate

14 upper surface of the rigid support 7
15 third small clamping plate
16 thread tail end
17, 17' rounded edges
18, 18' rounded edges

What is claimed is:

1. A thread clamping arrangement for a carrier gripper of a rapier loom comprising:

a rigid support coupled to an outer surface of a lateral wall of a body of the carrier gripper;

an elongated first clamping element;

an elongated second clamping element;

a clamping gap being formed by the first and second clamping elements; and a magnet coupled to the rigid support, wherein the magnet is spaced from the outer surface and exerts an attracting force on each of the first and second clamping elements.

2. The thread clamping arrangement of claim 1, wherein the first and second clamping elements are pressed against each other by the attracting force of the magnet.

3. The thread clamping arrangement of claim 1, wherein the clamping gap is adapted to receive a thread which is at least one of a weft thread, a filament thread, a glass thread, and a multifilament thread.

4. The thread clamping arrangement of claim 3, wherein the thread is adapted to be retained in the clamping gap after the thread is inserted therein.

5. The thread clamping arrangement of claim 1, wherein each of the first and second clamping elements are arranged between the rigid support and the lateral wall of the body.

6. The thread clamping arrangement of claim 1, wherein the magnet comprises a permanent magnet.

7. The thread clamping arrangement of claim 1, wherein the magnet comprises a magnetized elongated bar of square cross-section.

8. The thread clamping arrangement of claim 1, wherein the magnet is arranged to apply the attracting force to an elongated zone that is arranged between the first and second clamping elements.

9. The thread clamping arrangement of claim 1, wherein each of the first and second clamping elements comprise a thin elongated plate.

10. The thread clamping arrangement of claim 1, wherein each of the first and second clamping elements comprise one end that is freely movable and another end that is fixed.

11. The thread clamping arrangement of claim 10, wherein the fixed end of each of the first and second clamping elements is trapped between the rigid support and the lateral wall of the body.

12. The thread clamping arrangement of claim 11, wherein the magnet is arranged to apply the attracting force to an elongated zone that is arranged on the freely movable ends of the first and second clamping elements.

13. The thread clamping arrangement of claim 1, wherein the magnet is incorporated into the rigid support.

14. The thread clamping arrangement of claim 1, wherein the magnet is arranged in a recess that is formed in the rigid support.

15. The thread clamping arrangement of claim 1, wherein the first clamping element is arranged adjacent the rigid support and wherein the second clamping element is arranged adjacent the lateral wall of the body.

16. The thread clamping arrangement of claim 15, wherein the first clamping element comprises a thickness that is greater than a thickness of the second clamping element.

17. The thread clamping arrangement of claim 16, wherein the second clamping element is adapted to deform locally in order to trap a weft thread.

18. The thread clamping arrangement of claim 15, wherein the second clamping element is adapted to deform locally by the magnet in order to trap a weft thread.

19. The thread clamping arrangement of claim 1, wherein the second clamping element is adapted to deform locally in order to trap a weft thread.

20. The thread clamping arrangement of claim 1, wherein at least one of the first and second clamping elements is at least one of removably mounted and interchangeable.

21. The thread clamping arrangement of claim 1, wherein the magnet is at least one of removably mounted, exchangeable and interchangeable.

22. The thread clamping arrangement of claim 1, wherein the second clamping element is adapted to deform locally in order to trap a weft thread in such a manner that the weft thread is prevented from moving at least two directions.

23. A thread clamping arrangement for a carrier gripper of a rapier loom comprising:

a rigid support coupled to a lateral wall of a body of the carrier gripper;

an elongated first clamping element;

an elongated second clamping element;

a clamping gap being formed by the first and second clamping elements;

a magnet that exerts an attracting force on each of the first and second clamping elements; and at least one of a spacer and a plate arranged between the first and second clamping elements.

24. The thread clamping arrangement of claim 23, wherein each of the first and second clamping elements comprise one end that is freely movable and another end that is fixed.

25. The thread clamping arrangement of claim 24, wherein the fixed end of each of the first and second clamping elements, and the spacer or plate, is trapped between the rigid support and the lateral wall of the body.

26. A thread clamping arrangement for a carrier gripper of a rapier loom comprising:

a rigid support coupled to a lateral wall of a body of the carrier gripper;

an elongated first clamping element;

an elongated second clamping element;

a clamping gap being formed by the first and second clamping elements;

a magnet that exerts an attracting force on each of the first and second clamping elements; and a third clamping element coupled to the rigid support.

27. The thread clamping arrangement of claim 26, wherein at least one of the first, second and third clamping elements is fastened to the body of the carrier gripper.

28. The thread clamping arrangement of claim 26, wherein the third clamping element is pressed against the rigid support by the attracting force of the magnet.

29. The thread clamping arrangement of claim 28, wherein the third clamping element is attached to a surface of the rigid support that is oriented at approximately a right angle relative to one of the clamping gap and the lateral wall of the body.

30. The thread clamping arrangement of claim 29, further comprising another clamping gap formed by the third clamping element and the surface of the rigid support.

31. The thread clamping arrangement of claim 26, wherein the third clamping element is at least one of removably mounted, exchangeable and interchangeable.

32. The thread clamping arrangement of claim 26, wherein the third clamping element comprises a thickness that is adapted to a characteristic of a weft thread.

33. The thread clamping arrangement of claim 32, wherein the characteristic comprises a linear density of the weft thread.

34. The thread clamping arrangement of claim 32, wherein the characteristic comprises a linear density measured in tex of the weft thread.

35. The thread clamping arrangement of claim 26, wherein a thickness of the third clamping element is in the range of between approximately 0.1 mm and approximately 0.3 mm.

36. The thread clamping arrangement of claim 1, wherein a thickness of the second clamping element is in the range of between approximately 0.1 mm and approximately 0.5 mm.

37. The thread clamping arrangement of claim 36, wherein the thickness of the second clamping element is in the range of between approximately 0.2 mm and approximately 0.3 mm.

38. The thread clamping arrangement of claim 1, wherein each of the first and second clamping elements comprise one of curved and rounded edges.

39. The thread clamping arrangement of claim 1, wherein each of the first and second clamping elements comprise one of curved and rounded lateral side edges.

40. The thread clamping arrangement of claim 1, wherein each of the first and second clamping elements comprise one of curved and rounded free ends.

41. The thread clamping arrangement of claim 1, wherein each of the first and second clamping elements comprise a clamping surface which is at least one of smooth and highly polished.

42. A thread clamping arrangement for a carrier gripper of a rapier loom comprising:

a rigid support coupled to a lateral wall of a body of the carrier gripper;

an elongated first clamping element;

an elongated second clamping element;

a clamping gap being formed by the first and second clamping elements;

a magnet that exerts an attracting force on each of the first and second clamping elements; and a third clamping element having a thickness ranging from approximately 0.1 mm to approximately 0.3 mm.

43. The thread clamping arrangement of claim 1, wherein the magnet exerts an attracting force which is in the range of between approximately 20 g and approximately 200 g measured as a tensile force required for pulling a thread out of the clamping arrangement.

44. The thread clamping arrangement of claim 1, wherein the clamping gap is adapted to retain filament threads of a linear density ranging from approximately 5.5 tex to approximately 140 tex.

45. A thread clamping arrangement for a carrier gripper of a rapier loom comprising:

a rigid support coupled to a lateral wall of a body of the carrier gripper;

an elongated first clamping element;

an elongated second clamping element;

a clamping gap being formed by the first and second clamping elements;

a magnet that exerts an attracting force on each of the first and second clamping elements; and at least one of a spacer and a plate arranged between the first and second clamping elements, wherein at least one of the second clamping element and the at least one of the spacer and the plate is exchangeable.

46. A thread clamping arrangement for a carrier gripper of a rapier loom comprising:

a support coupled to an outer surface of a body of the carrier gripper;

a thin elongated first clamping element;

a thin elongated second clamping element;

a clamping gap being formed by the first and second clamping elements; and a magnet coupled to the support, wherein the magnet is spaced from the outer surface and causes the second clamping element to move towards the first clamping element.

47. A thread clamping arrangement for a carrier gripper of a rapier loom comprising:

a support coupled to a body of the carrier gripper;

a thin elongated first clamping element;

a thin elongated second clamping element;

a thin elongated third clamping element;

a main clamping gap being formed by the first and second clamping elements;

an additional clamping gap being formed by the third clamping element and the support; and a magnet, wherein the magnet exerts an attractive force on each of the first, the second and the third clamping elements.

* * * * *